US011552426B1

(12) United States Patent
Sundarakrishnamachari et al.

(10) Patent No.: US 11,552,426 B1
(45) Date of Patent: Jan. 10, 2023

(54) SEALED ELECTRICAL CONNECTOR HAVING A MALE BLADE STABILIZER WITH A SEAL RETENTION FEATURE

(71) Applicant: Aptiv Technologies Limited, St. Michael (BB)

(72) Inventors: Rangarajan Sundarakrishnamachari, Chennai (IN); Sivakumar Jogula, Nagar Kurnool (IN)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 27 days.

(21) Appl. No.: 17/351,538

(22) Filed: Jun. 18, 2021

(51) Int. Cl.
*H01R 13/52* (2006.01)
*H01R 13/627* (2006.01)
*H01R 13/502* (2006.01)

(52) U.S. Cl.
CPC ..... *H01R 13/5219* (2013.01); *H01R 13/502* (2013.01); *H01R 13/6273* (2013.01)

(58) Field of Classification Search
CPC ..... H01R 13/5219; H01R 13/502; H01R 13/6273
See application file for complete search history.

(56) References Cited

U.S. PATENT DOCUMENTS 6,752,644 B2 * 6/2004 Shibata ..... H01R 13/5219 439/271
6,761,568 B2 7/2004 Bakker et al.
8,038,455 B1 10/2011 Moraes et al.
9,054,454 B2 * 6/2015 Gomez ..... H01R 13/4538
9,608,357 B1 3/2017 Sundarakrishnamachari et al.
10,236,629 B2 3/2019 Narro et al.
10,493,675 B2 * 12/2019 Bucco ..... B29C 45/0025
11,258,199 B2 * 2/2022 Baek ..... H01R 13/6272
11,309,650 B2 * 4/2022 George ..... H01R 13/28
11,394,151 B2 * 7/2022 Sundarakrishnamachari ..... H01R 13/4364
2003/0171020 A1 * 9/2003 Shibata ..... H01R 13/5219 439/271
2020/0144761 A1 * 5/2020 George ..... H01R 13/62

* cited by examiner

*Primary Examiner* — Abdullah A Riyami
*Assistant Examiner* — Nader J Alhawamdeh
(74) *Attorney, Agent, or Firm* — Billion & Armitage

(57) ABSTRACT

A sealed connector assembly includes a female connector having an inner wall, an outer wall substantially parallel to the inner wall, and a resilient seal circumferentially extending from the inner wall and a male connector having a shroud extending parallel to the mating axis and a male blade stabilizer (MBS) moveable from a pre-staged position to a fully staged position and back to the pre-staged position. The MBS is configured to move from the pre-staged position to the fully staged position as the shroud is received between the outer wall and the resilient seal, thereby disposing the MBS between the inner and outer walls and retaining the resilient seal in an intended location. The MBS remains engaged to female connector until the shroud is withdrawn from between the outer wall and the resilient seal, thereby retaining the resilient seal in the intended location as the male connector is unmated.

19 Claims, 12 Drawing Sheets

SEALED ELECTRICAL CONNECTOR HAVING A MALE BLADE STABILIZER WITH A SEAL RETENTION FEATURE

This patent application is directed to a sealed electrical connector assembly, particularly a connector assembly having a male blade stabilizer with a seal retention feature.

BACKGROUND

In automotive electrical connectors, sealing is a safety critical function to protect the connector system from failure due to water intrusion. There is a seal failure mode where the connector seal tends to roll out during connector assembly disengagement. Various design solutions have been implemented to retain the seal in position, e.g., extending integrated/independent secondary locks or primary lock retainers, adding seal retaining features to the inner housing, etc. When these solutions are not feasible, a dedicated seal retainer component is added to retain the seal which increases the overall cost of the connector system.

SUMMARY

According to one or more aspects of the present disclosure, a sealed electrical connector assembly includes a female connector having an inner wall extending parallel to a mating axis, an outer wall substantially parallel to the inner wall, and a resilient seal circumferentially extending from the inner wall. The sealed electrical connector assembly also includes a male connector having a shroud extending parallel to the mating axis and a male blade stabilizer (MBS) moveable from a pre-staged position to a fully staged position and back to the pre-staged position. The male connector is configured to mate with the female connector A portion of the MBS is disposed between the inner and outer walls and retains the resilient seal in an intended location. The MBS remains engaged with the female connector until the shroud is withdrawn from between the outer wall and the resilient seal, thereby retaining the resilient seal in the intended location as the male connector is unmated from the female connector.

In one or more embodiments of the sealed electrical connector assembly according to the previous paragraph, the MBS is configured to move from the fully staged position to the pre-staged position as the male connector is unmated from the female connector.

In one or more embodiments of the sealed electrical connector assembly according to any one of the previous paragraphs, the male connector further includes a plurality of male terminals. The MB S is configured to stabilize free ends of the plurality of male terminals when the MBS is in the pre-staged position.

In one or more embodiments of the sealed electrical connector assembly according to any one of the previous paragraphs, the female connector further includes a plurality of female terminals configured to mate with the plurality of male terminals.

In one or more embodiments of the sealed electrical connector assembly according to any one of the previous paragraphs, the MBS includes a perforated plate through which the plurality of male terminals extends. The portion of the MBS defines a skirt extending from the perforated plate in a direction parallel to the mating axis. The skirt has a free end configured to retain the resilient seal when the male and female connectors are fully mated.

In one or more embodiments of the inner wall, the outer wall, and the resilient seal surround the plurality of male terminals.

In one or more embodiments of the sealed electrical connector assembly according to any one of the previous paragraphs, the MBS is configured to be in the pre-staged position prior to the shroud being disposed between the outer wall and the resilient seal as the male connector is mated with the female connector.

In one or more embodiments of the sealed electrical connector assembly according to any one of the previous paragraphs, the MBS is configured to remain engaged to female connector until the shroud is no longer disposed between the outer wall and the resilient seal as the male connector is unmated from the female connector.

According to one or more aspects of the present disclosure, a sealed electrical connector assembly includes a female connector having an inner wall extending parallel to a mating axis, an outer wall substantially parallel to the inner wall, and a resilient seal circumferentially and partially extending between the inner and outer walls. The sealed electrical connector assembly further includes a male connector having a shroud extending parallel to the mating axis and configured to engage the resilient seal as the shroud is inserted within the female connector between the inner and outer walls and a male blade stabilizer (MBS) defining flexible retraction locks. The MBS is moveable from a pre-staged position to a fully staged position. The female connector defines rigid retraction locks configured to engage the flexible retraction locks and pull the MBS from the fully staged position back to the pre-staged position as the male connector is withdrawn from the female connector.

In one or more embodiments of the sealed electrical connector assembly according to the previous paragraph, the rigid retraction locks are sized and shaped to ensure that the MBS engages with the female connector while the shroud engages the resilient seal.

In one or more embodiments of the sealed electrical connector assembly according to any one of the previous paragraphs, the MBS is in contact with the resilient seal when the MBS is engaged to female connector.

In one or more embodiments of the sealed electrical connector assembly according to any one of the previous paragraphs, the male connector further includes a plurality of male terminals and the MBS is configured to stabilize free ends of the plurality of male terminals when the MBS is in the pre-staged position.

In one or more embodiments of the sealed electrical connector assembly according to any one of the previous paragraphs, the MBS has a perforated plate through which the plurality of male terminals extends. The MB S defines a skirt extending from the perforated plate in a direction parallel to the mating axis. The skirt has a free end configured to retain the resilient seal when the MBS is engaged to female connector.

In one or more embodiments of the sealed electrical connector assembly according to any one of the previous paragraphs, the MBS defines a plurality of retention arms extending perpendicularly from the perforated plate.

In one or more embodiments of the sealed electrical connector assembly according to any one of the previous paragraphs, free ends of the plurality of retention arms engage the resilient seal when the MBS is fully engaged to female connector.

In one or more embodiments of the sealed electrical connector assembly according to any one of the previous paragraphs, the MBS is in contact with the resilient seal when the MBS is engaged to female connector.

In one or more embodiments of the sealed electrical connector assembly according to the previous paragraph, free ends of the plurality of retention arms contact the resilient seal when the MBS is fully engaged to female connector.

In one or more embodiments of the sealed electrical connector assembly according to any one of the previous paragraphs, the female connector further includes a plurality of female terminals configured to mate with the plurality of male terminals.

According to one or more aspects of the present disclosure, a sealed electrical connector assembly includes a female connector having a wall extending parallel to a mating axis and a resilient seal circumferentially extending from the wall and a male connector having a shroud extending parallel to the mating axis and configured to engage the resilient seal as the shroud is inserted within the female connector in a location outboard of the wall and resilient seal. The male connector further has a moveable means for retaining the resilient seal in a desired location as the shroud disengages the resilient seal when the male connector is disconnected from the female connector.

In one or more embodiments of the sealed electrical connector assembly according to the previous paragraph, the male connector further includes a plurality of male terminals and means for stabilizing free ends of the plurality of male terminals.

In one or more embodiments of the sealed electrical connector assembly according to any one of the previous paragraphs, the means for stabilizing the free ends of the plurality of male terminals is integral with the moveable means for retaining the resilient seal.

DESCRIPTION OF THE DRAWINGS

The present invention will now be described, by way of example with reference to the accompanying drawings, in which.

DETAILED DESCRIPTION

A non-limiting example of a sealed connector assembly, hereinafter referred to as the assembly 10, shown in FIG. 1 through FIG. 10 has a male connector 12 and a female connector 14 that, as described herein, provides a solution to the problems with seal roll out as described in the BACKGROUND section above.

Figure 1:
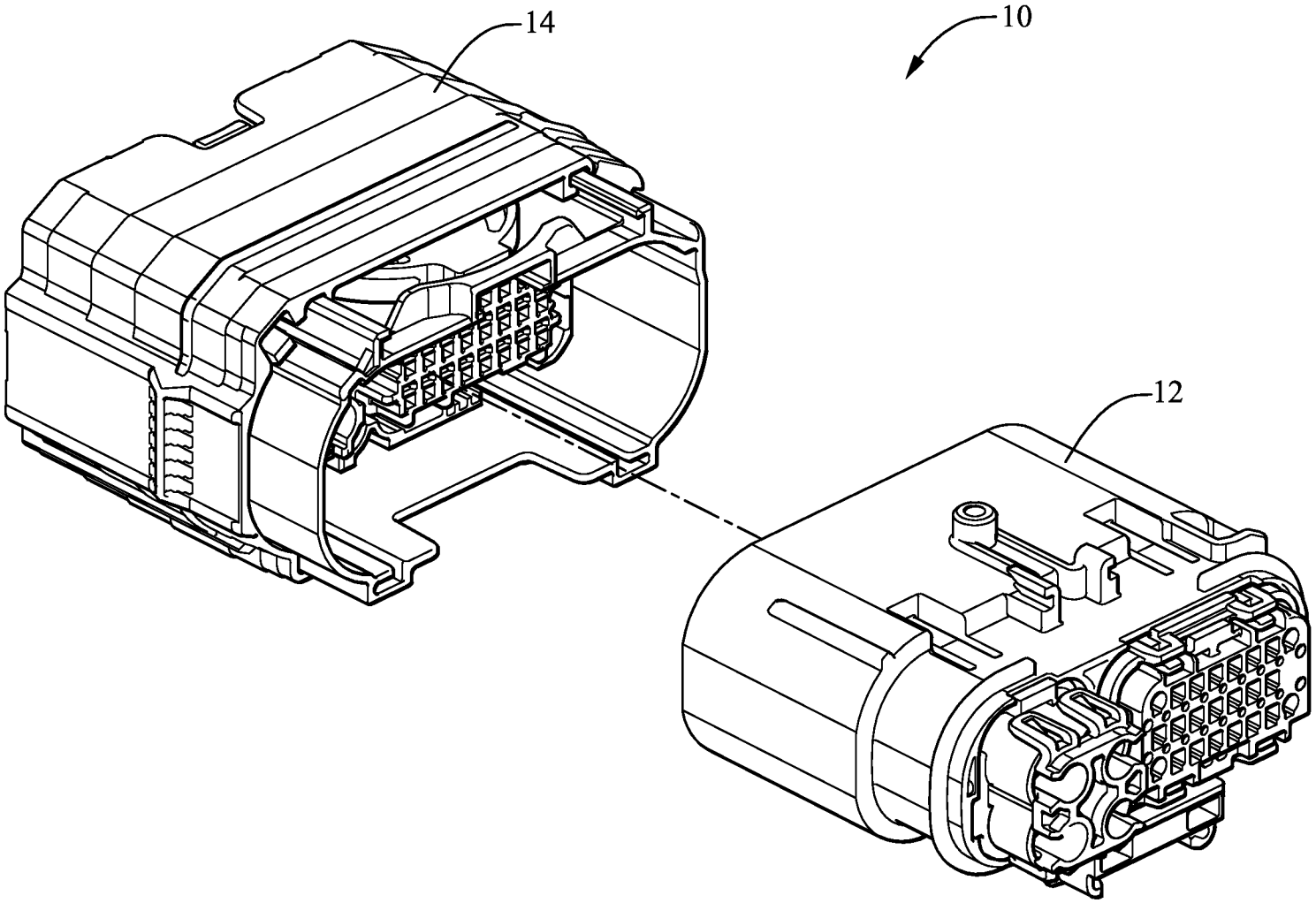
FIG. 1 is a perspective view of a sealed connector assembly in a disconnected condition according to some embodiments.
Figure 2:
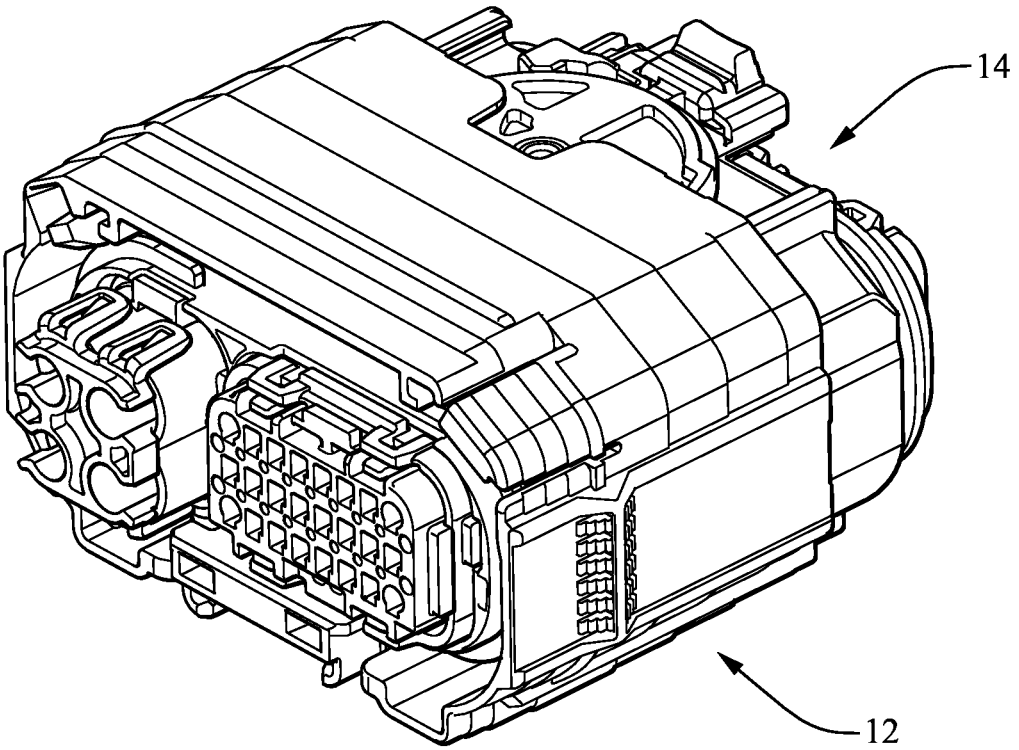
FIG. 2 is a perspective view of the sealed connector assembly of FIG. 1 in a connected condition according to some embodiments.
Figure 3:
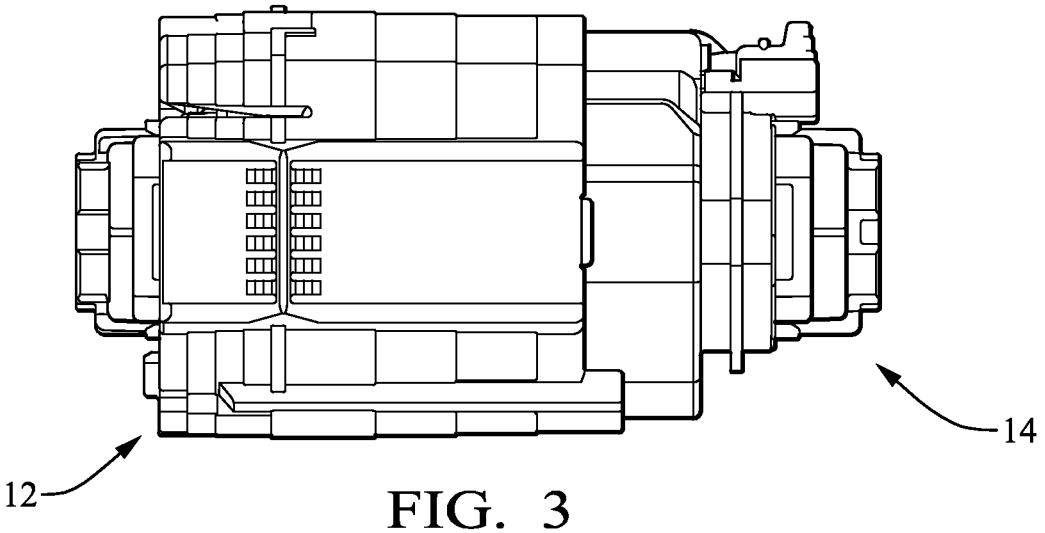
FIG. 3 is a side plan view of the sealed connector assembly of FIG. 2 according to some embodiments.
Figure 4:
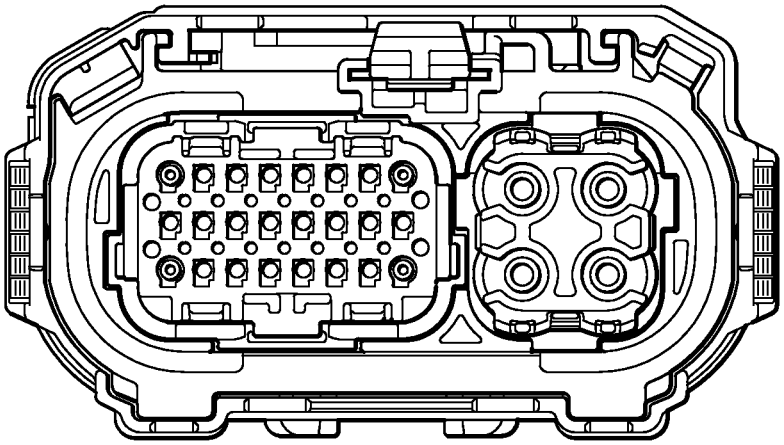
FIG. 4 is an end plan view of the sealed connector assembly of FIG. 2 according to some embodiments.
Figure 5:
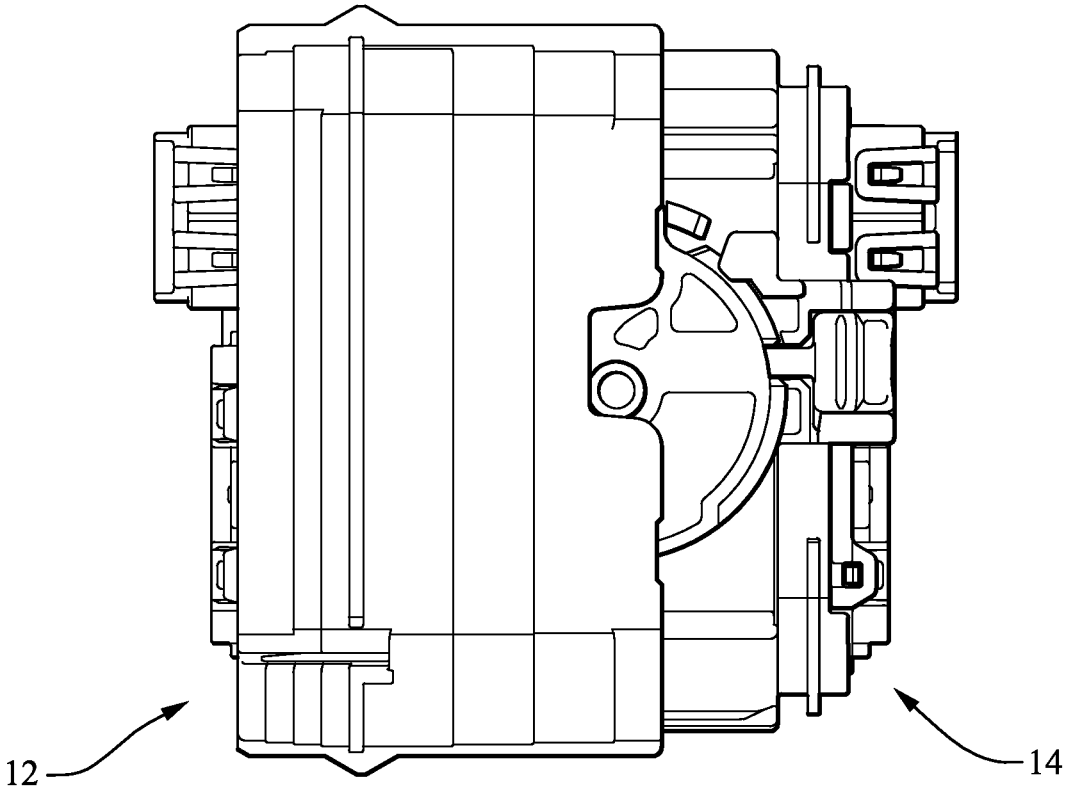
FIG. 5 is a top plan view of the sealed connector assembly of FIG. 2 according to some embodiments.
Figure 6:
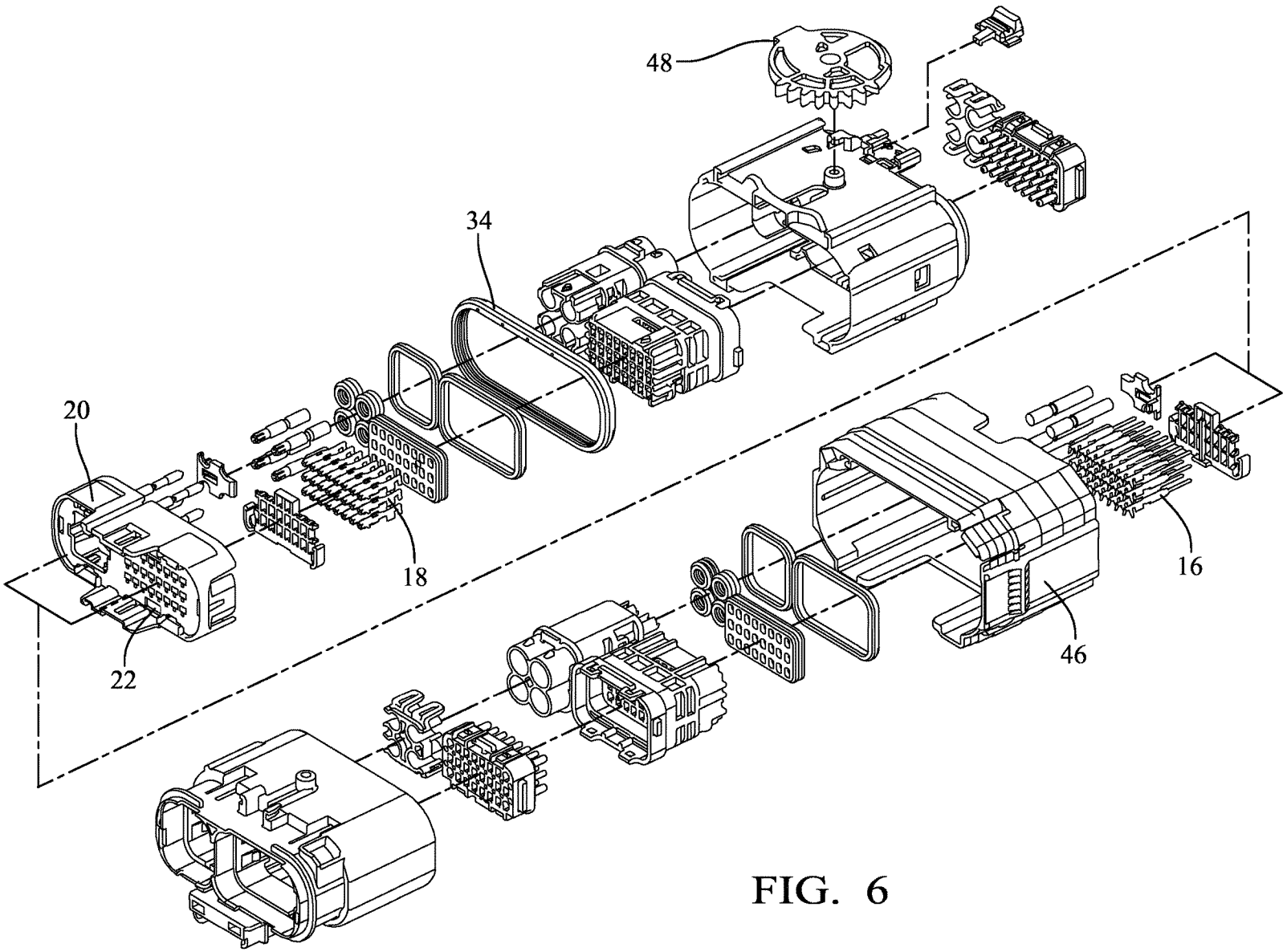
FIG. 6 is an exploded view of the sealed connector assembly of FIG. 2 according to some embodiments.
Figure 7:
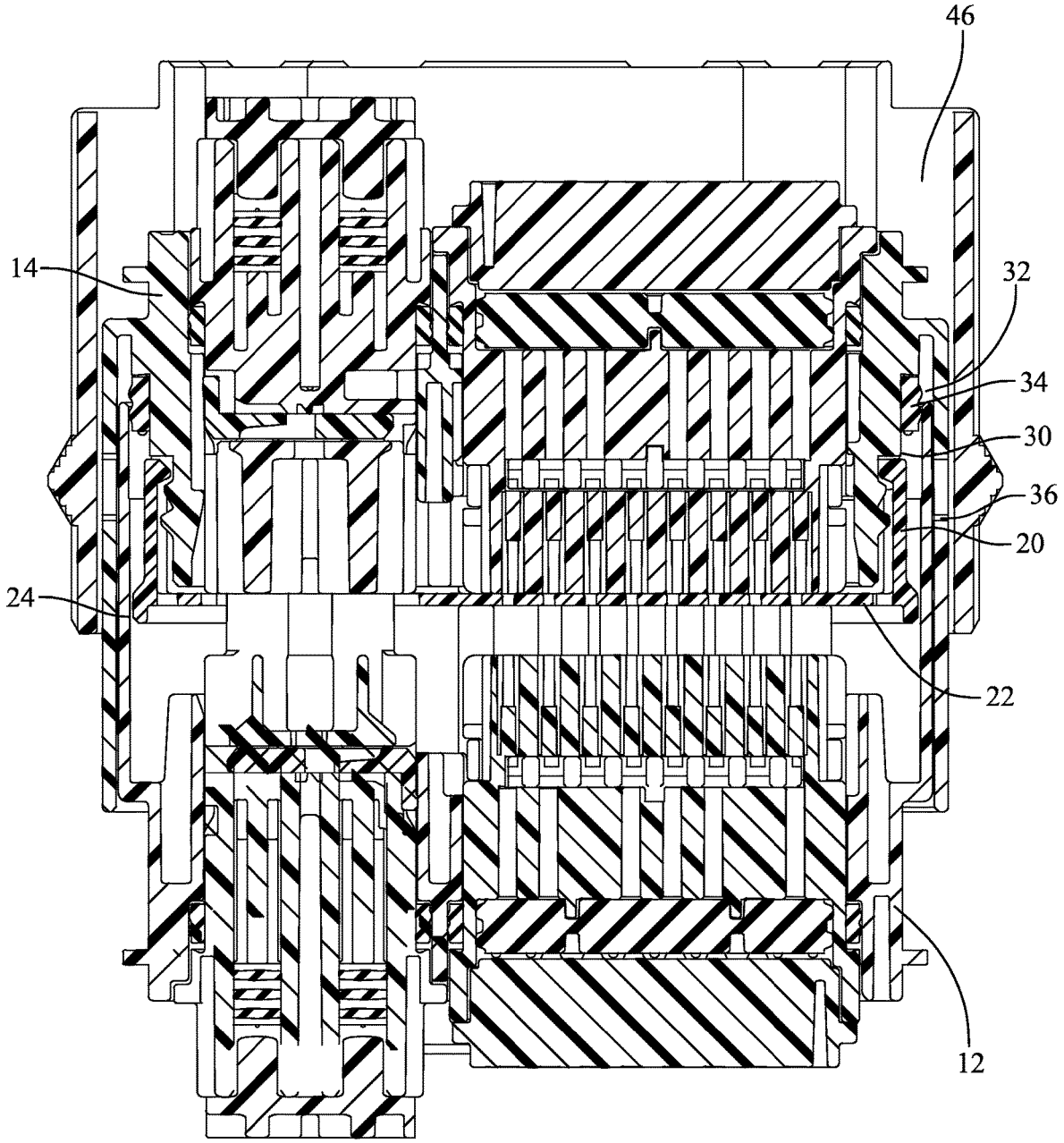
FIG. 7 is a cross section top view of the sealed connector assembly of FIG. 2 with the male connector and the female connector in an initial stage of connection and the male blade stabilizer in a pre-staged position according to some embodiments.
Figure 8:
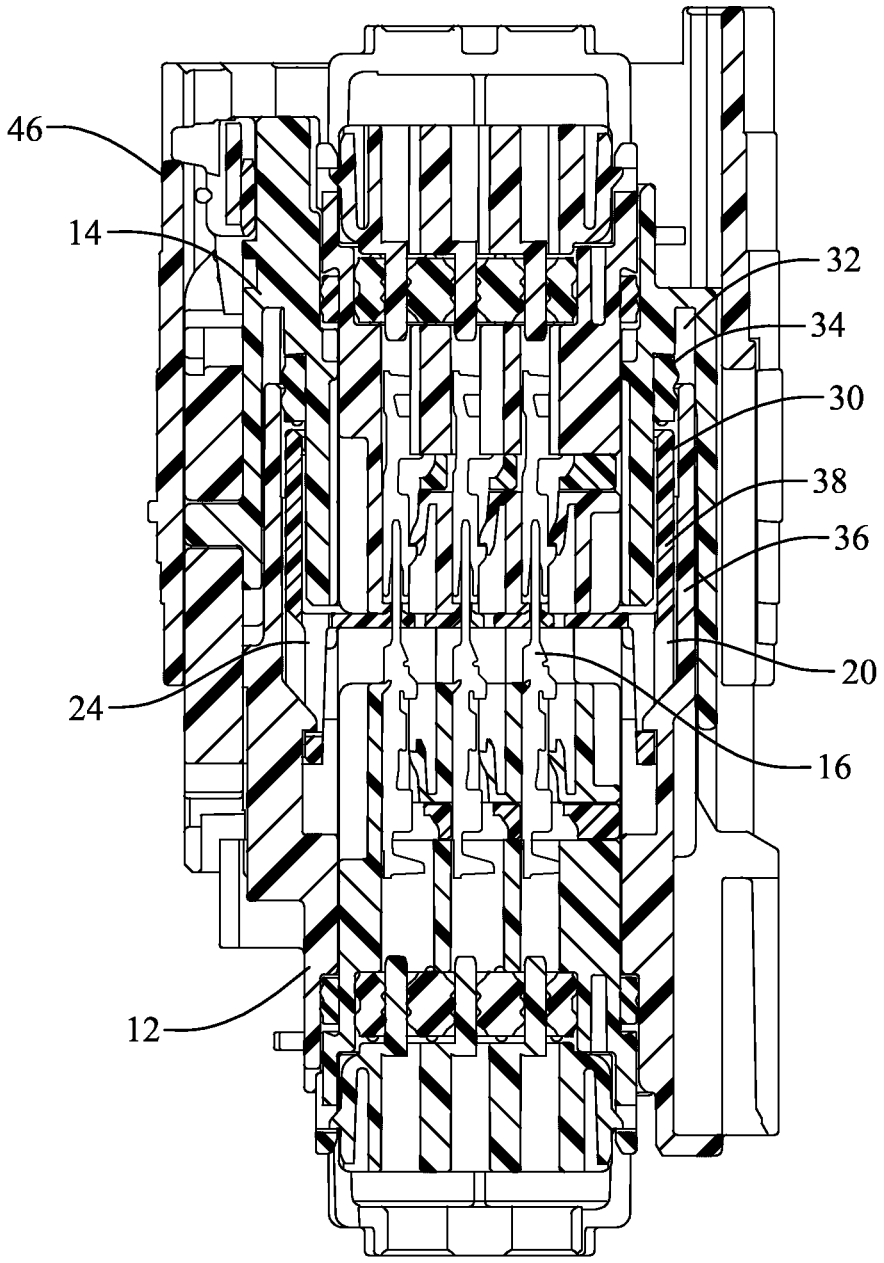
FIG. 8 is a cross section side view of the sealed connector assembly of FIG. 2 with the male connector and the female connector in the initial stage of connection and the male blade stabilizer in the pre-staged position according to some embodiments.
Figure 9:
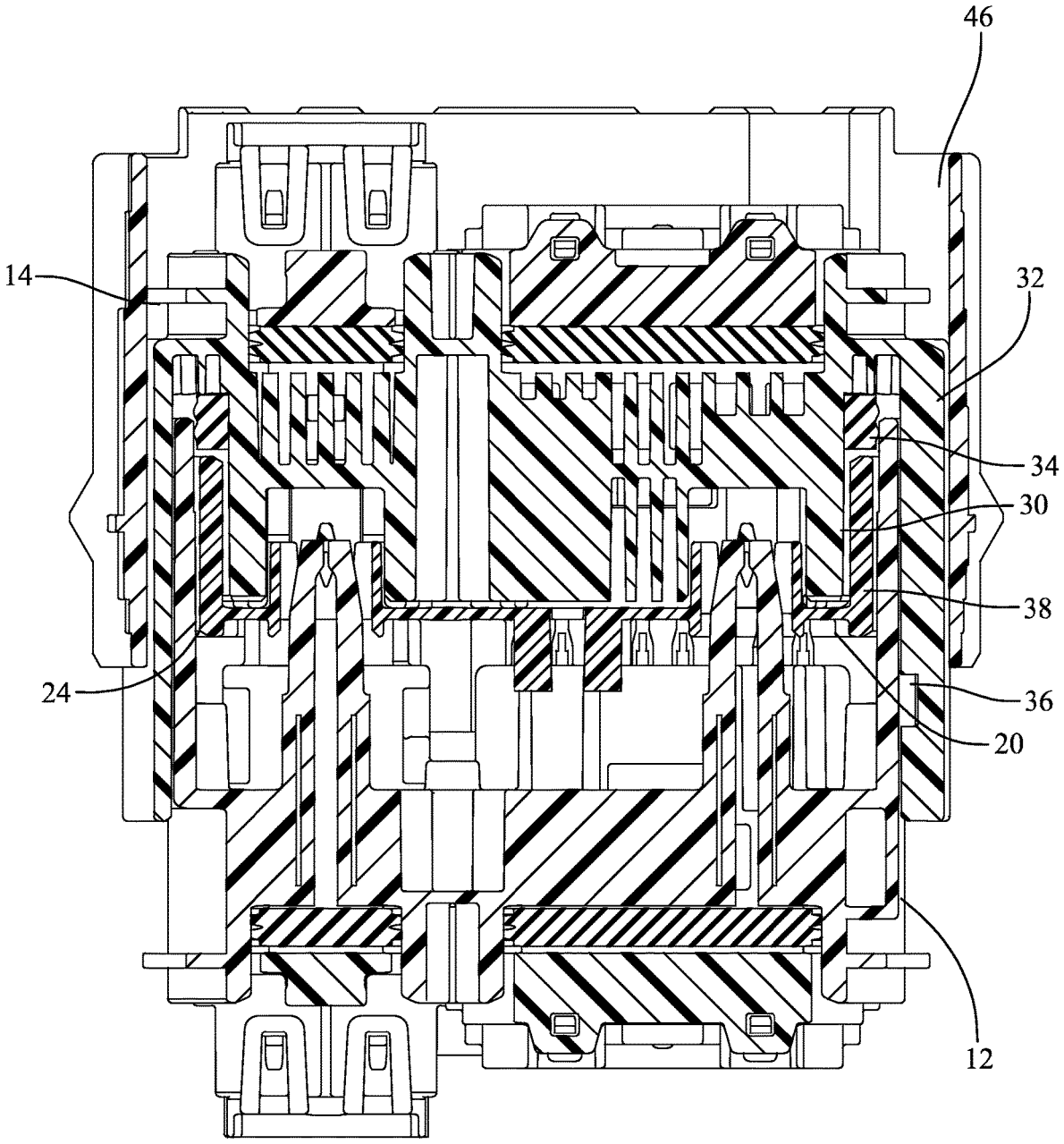
FIG. 9 is an alternative cross section top view of the sealed connector assembly of FIG. 2 with the male connector and the female connector in the initial stage of connection and the male blade stabilizer in the pre-staged position according to some embodiments.
Figure 10:
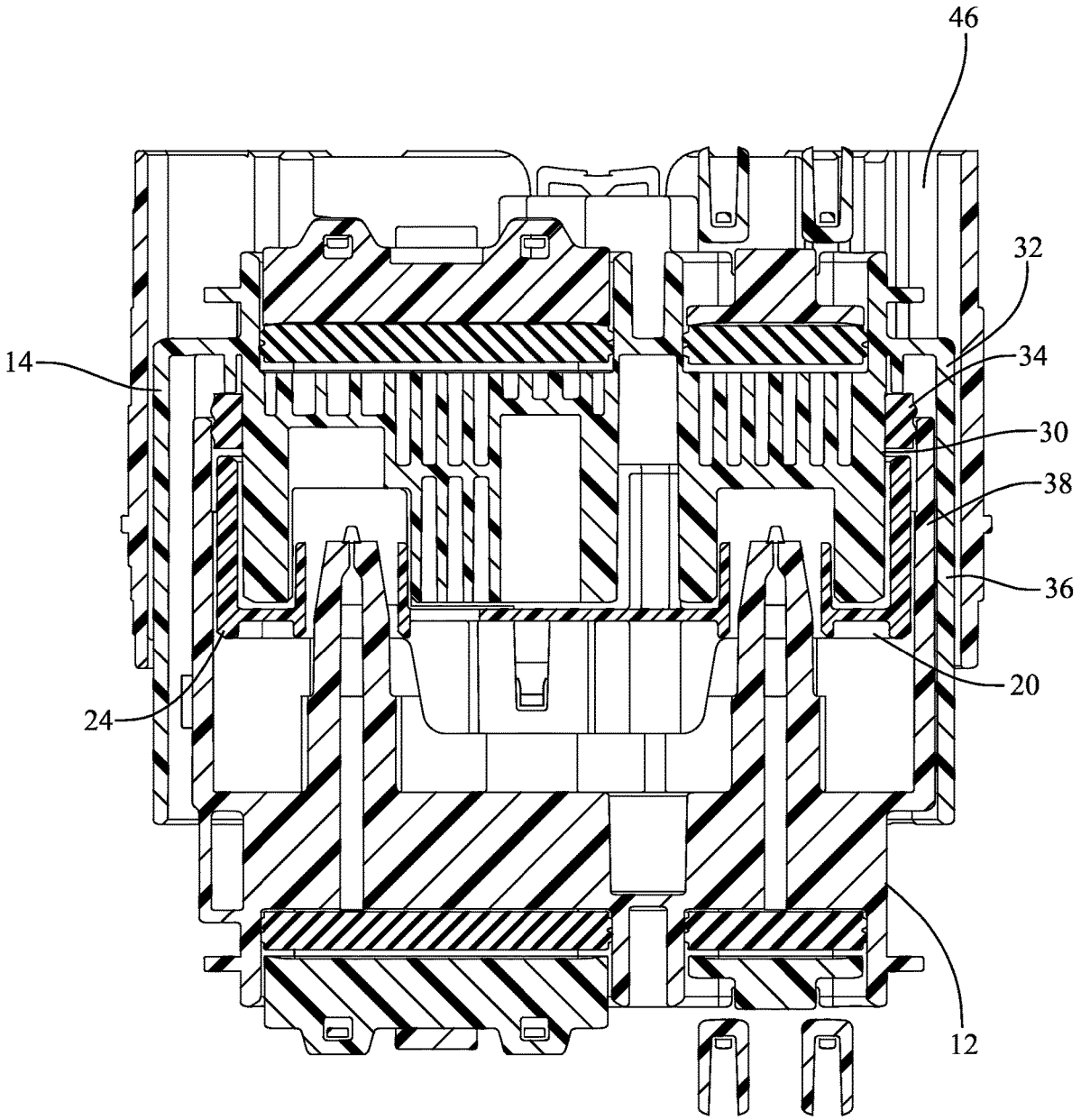
FIG. 10 is yet another alternative cross section top view of the sealed connector assembly of FIG. 1 with the male connector and the female connector in the initial stage of connection and the male blade stabilizer in the pre-staged position according to some embodiments.
Figure 11:
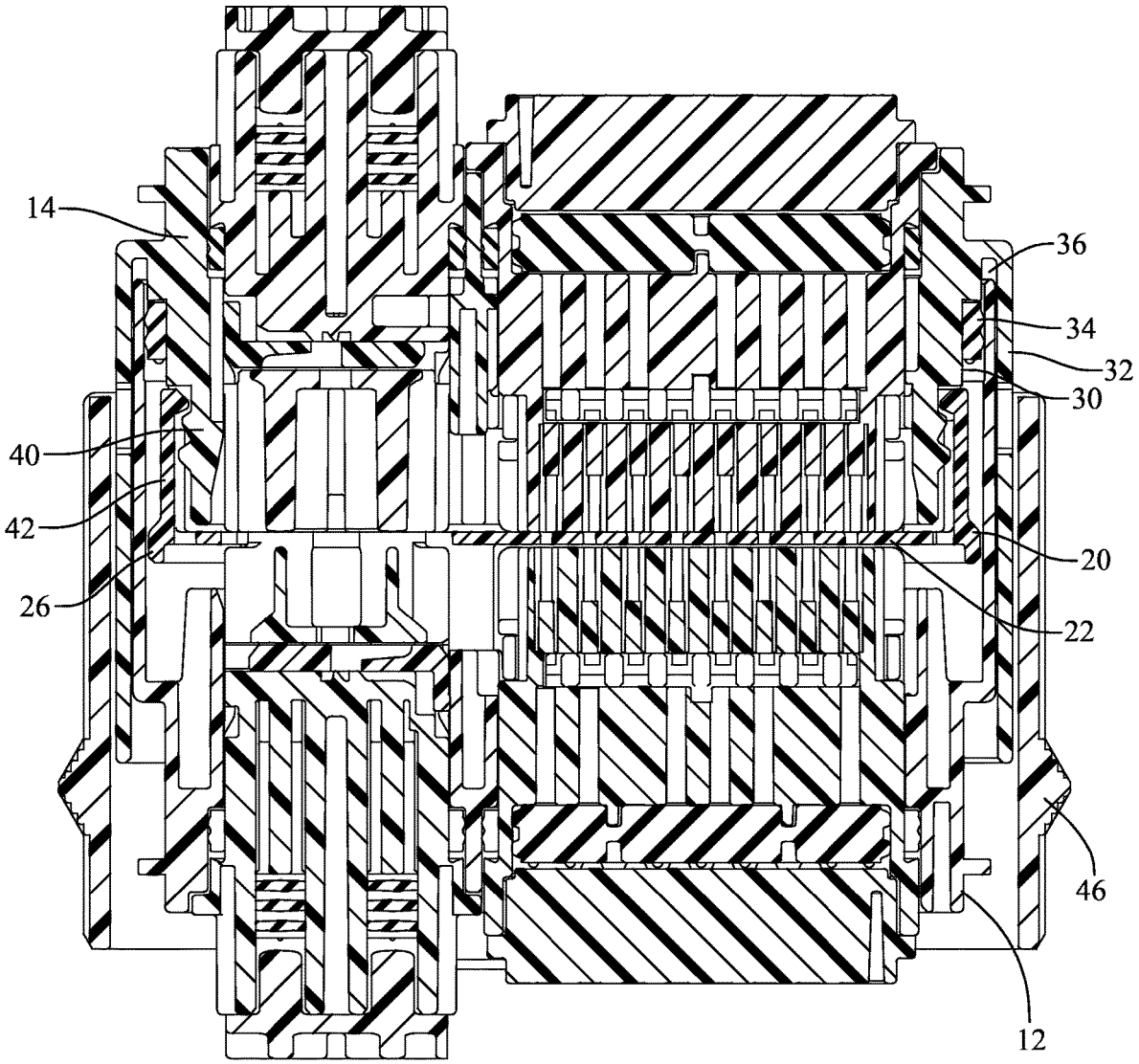
FIG. 11 is a cross section top view of the sealed connector assembly of FIG. 1 with the male connector and the female connector in a final stage of connection and the male blade stabilizer in a fully staged position according to some embodiments.
Figure 12:
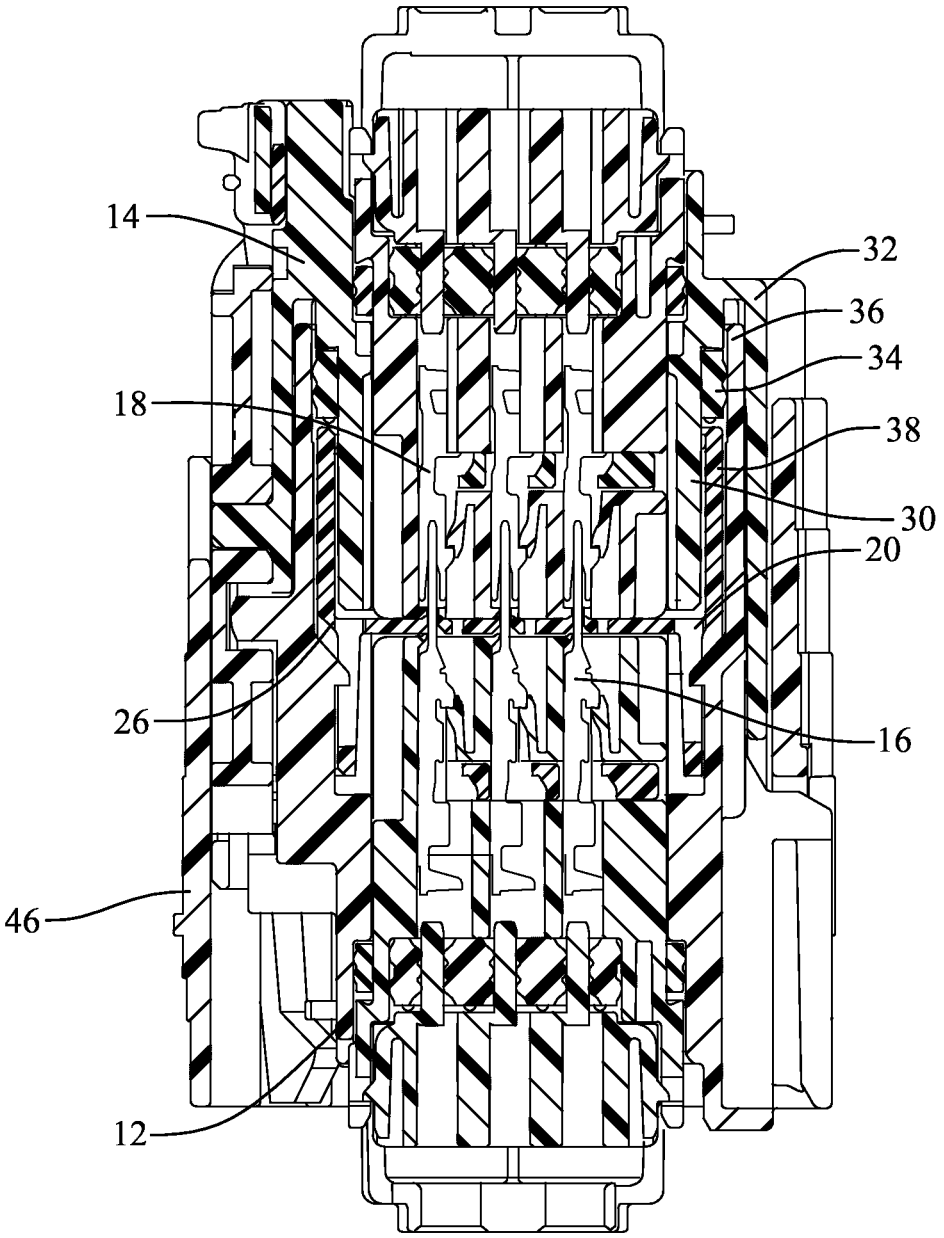
FIG. 12 is a cross section side view of the sealed connector assembly of FIG. 1 with the male connector and the female connector in the final stage of connection and the male blade stabilizer in the fully staged position according to some embodiments.
Figure 13:
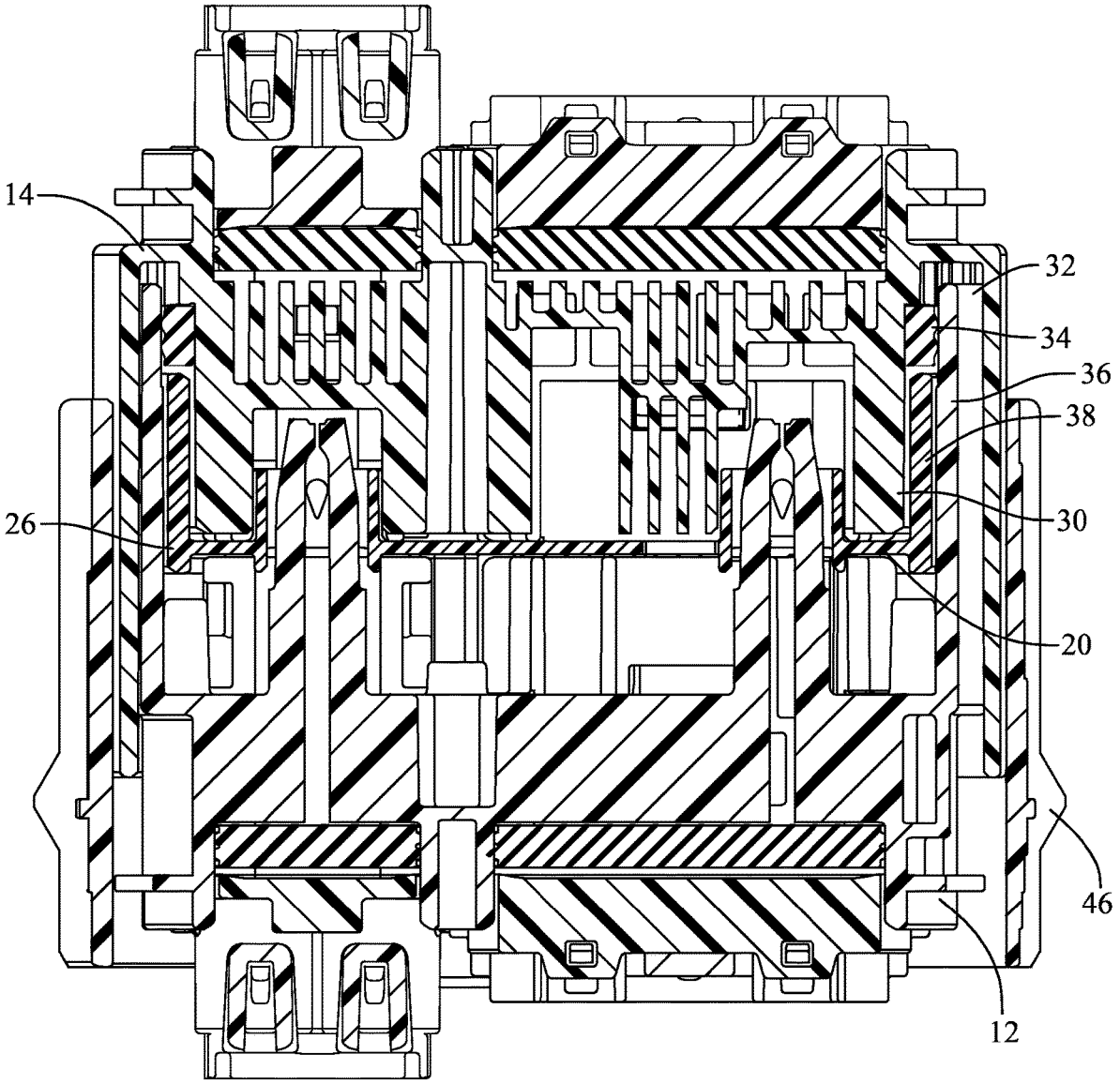
FIG. 13 is an alternative cross section top view of the sealed connector assembly of FIG. 1 with the male connector and the female connector in the final stage of connection and the male blade stabilizer in the fully staged position according to some embodiments.
Figure 14:
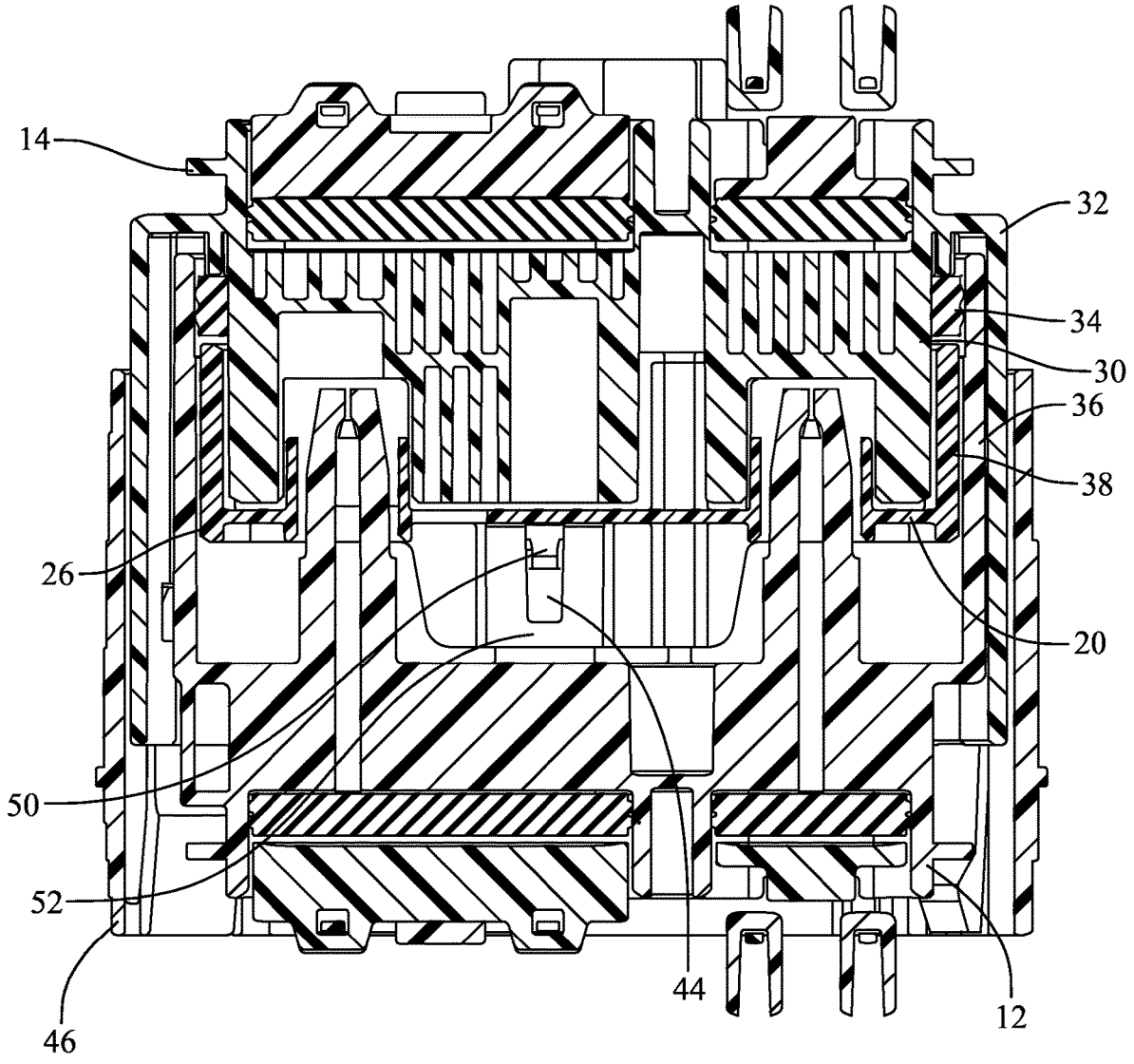
FIG. 14 is yet another alternative cross section top view of the sealed connector assembly of FIG. 1 with the male connector and the female connector in the final stage of connection and the male blade stabilizer in the fully staged position according to some embodiments.

The male connector 12 includes a plurality of male blade terminals 16 and the female connector includes a plurality of corresponding female socket terminals 18 that mate with the plurality of male terminals 16. The male connector 12 has a moveable male blade stabilizer, hereinafter referred to as the MBS 20 having a perforated plate 22. When the male connector 12 is in an unconnected condition as shown in FIG. 1, the MBS 20 is in a pre-staged position 24 shown in FIGS. 7 to 10 in which tips of the male terminals 16 are held in apertures in the perforated plate 22 and supported so that they are protected from being bent off axis by inadvertent contact with a foreign object during shipping or handling. As the male connector 12 is mated with the female connector 14, the MBS 20 moves from the pre-staged position 24 to a fully staged position 26, shown in FIGS. 11 to 14, near the bases of the plurality of male terminals 16. The male terminals 16 are allowed to fully mate with the female terminals 18 when the MBS 20 is in the fully staged position 26.

The female connector 14 has an inner wall 30 extending parallel to a longitudinal mating axis X and an outer wall 32 arranged substantially parallel to the inner wall 30. A seal 34 circumferentially extends between the inner and outer walls 30, 32 of the female connector 14. The male connector 12 defines a shroud 36 extending parallel to the mating axis X. The shroud 36 longitudinally surrounds the plurality of male terminals 16 and is configured to engage the seal 34 as the shroud 36 is inserted within the female connector 14 between the inner and outer walls 30, 32. When the male and female connectors 12, 14 are in a fully mated condition as shown in FIGS. 11 to 14, the shroud 36 is disposed between the outer wall 32 and the seal 34. The seal 34 is formed of a resilient material, such as a silicone rubber and is configured to prevent environmental contaminants, such as water or dust, from entering the assembly 10 and contacting the male and female terminals 16, 18. The MBS 20 defines a plurality of retention arms which, in the illustrated example, form a skirt 38 that extends from the perforated plate 22 and is fit between the shroud 36 and the inner wall 30. When the MBS 20 is fully engaged with the female connector 14, the skirt 38 engages the seal 34 and inhibits roll out of the seal 34 as the shroud 36 is withdrawn from the seal 34 as the male and female connectors 12, 14 are disconnected.

The position of MBS 20 and its skirt 38 is controlled by an event driven mechanism. When the male and female connectors 12, 14 are fully mated, there is a gap 44 between the rigid retention locks 50 on the male connector 12 and the flexible retention locks 52 on the MBS 20. During unmating, the skirt 38 of the MBS 20 remains engaged with the seal 34 in the female connector 14 when the shroud 36 starts disengaging from the seal 34. The skirt 38 remains engaged with the seal 34 until the rigid retention locks 50 move along the entire length of the gap 44 and engage the flexible retention locks 52. This arrangement ensures that the MBS 20 stays engaged with the female connector 14 and retains the seal 34 in its intended location. The disengagement of MBS 20 from the female connector 14 takes place only after shroud 36 and seal 34 are partially disengaged, thereby providing relief for the compressed seal 34. This relief allows the seal 34 to expand in the direction opposite to disengagement direction, thereby preventing the roll out of the seal 34.

The connector also includes a mate assist slider 46 that is moveable from an unmated position to a mated position. The mate assist slider 46 is longitudinally mounted to the female connector 12 and is configured to move in a direction parallel to the longitudinal axis X of the male connector 12. The mate assist slider 46 surrounds a portion of the female connector 14 and includes a gear rack having rack teeth (not shown) that are configured to engage a cam gear 48 mounted on the female connector 14. The cam gear 48 has gear teeth that engage the rack teeth such that the cam gear 48 moves in response to a movement of the mate assist slider from the unmated position to the mated position.

The male connector 14 defines a rigid retention lock 50 and the MBS 20 defines a flexible retention lock 52. Once the shroud is partially disengaged from the seal, the rigid retention lock 50 on the male connector engages with the flexible retention lock 52 on the MBS 20 and starts pulling the MBS 20 away from the female connector 14.

Accordingly, a sealed electrical connector assembly is presented. The assembly 10 provides the benefit of a single movable structure, i.e., MBS 20, that both stabilizes the male terminals 16 when the male and female connectors 12, 14 are disconnected but also retains the seal 34 between in the female connector 14 when the male and female connectors 12, 14 are connected and when in the process of being disconnected. The MBS 20 eliminates the need for a separate male blade stabilizer and a separate seal retainer, thereby reducing the part count and assembly steps for the assembly 10 which also reduces part and assembly costs.

While the invention has been described with reference to an exemplary embodiment(s), it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention is not limited to the disclosed embodiment(s), but that the invention will include all embodiments falling within the scope of the appended claims.

The invention claimed is:

1. A sealed electrical connector assembly, comprising:

a female connector having an inner wall extending parallel to a mating axis, an outer wall substantially parallel to the inner wall, and a resilient seal circumferentially extending from the inner wall; and a male connector having a shroud extending parallel to the mating axis and comprising a plurality of male terminals and a male blade stabilizer (MBS) moveable from a pre-staged position to a fully staged position and back to the pre-staged position, wherein the male connector is configured to mate with the female connector, wherein a portion of the MBS is disposed between the inner and outer walls and retains the resilient seal in an intended location, wherein the MBS remains engaged with the female connector until the shroud is withdrawn from between the outer wall and the resilient seal, thereby retaining the resilient seal in the intended location as the male connector is unmated from the female connector, wherein the MBS comprises a perforated plate through which the plurality of male terminals extends, wherein the portion of the MBS comprises a skirt extending from the perforated plate in a direction parallel to the mating axis, and wherein the skirt has a free end configured to retain the resilient seal when the male and female connectors are fully mated.

2. The sealed electrical connector assembly according to claim 1, wherein the MBS is configured to move from the fully staged position to the pre-staged position as the male connector is unmated from the female connector.

3. The sealed electrical connector assembly according to claim 1, wherein the MBS is configured to stabilize free ends of the plurality of male terminals when the MBS is in the pre-staged position.

4. The sealed electrical connector assembly according to claim 3, wherein the female connector further comprises a plurality of female terminals configured to mate with the plurality of male terminals.

5. The sealed electrical connector according to claim 1, wherein the inner wall, the outer wall, and the resilient seal surround the plurality of male terminals.

6. The sealed electrical connector according to claim 1, wherein the MBS is configured to be in the pre-staged position prior to the shroud being disposed between the outer wall and the resilient seal as the male connector is mated with the female connector.

7. The sealed electrical connector according to claim 1, wherein the MBS is configured to remain engaged to female connector until the shroud is no longer disposed between the outer wall and the resilient seal as the male connector is unmated from the female connector.

8. A sealed electrical connector assembly, comprising:

a female connector having an inner wall extending parallel to a mating axis, an outer wall substantially parallel to the inner wall, and a resilient seal circumferentially and partially extending between the inner and outer walls; and a male connector having a shroud extending parallel to the mating axis and configured to engage the resilient seal as the shroud is inserted within the female connector between the inner and outer walls and a male blade stabilizer (MBS) defining flexible retraction locks, wherein the MBS is moveable from a pre-staged position to a fully staged position, wherein the female connector defines rigid retraction locks configured to engage the flexible retraction locks and pull the MBS from the fully staged position back to the pre-staged position as the male connector is withdrawn from the female connector.

9. The sealed electrical connector assembly according to claim 8, wherein the rigid retraction locks are sized and shaped to ensure that the MBS engages with the female connector while the shroud engages the resilient seal.

10. The sealed electrical connector assembly according to claim 8, wherein the MBS is in contact with the resilient seal when the MBS is engaged to female connector.

11. The sealed electrical connector assembly according to claim 8, wherein the male connector further comprises a plurality of male terminals and wherein the MBS is further configured to stabilize free ends of the plurality of male terminals when the MBS is in the pre-staged position.

12. The sealed electrical connector assembly according to claim 11, wherein the MBS comprises a perforated plate through which the plurality of male terminals extends, wherein the MBS comprises a skirt extending from the perforated plate in a direction parallel to the mating axis, and wherein the skirt has a free end configured to retain the resilient seal when the MBS is engaged to female connector.

13. The sealed electrical connector assembly according to claim 12, wherein the MBS defines a plurality of retention arms extending perpendicularly from the perforated plate.

14. The sealed electrical connector assembly according to claim 13, wherein free ends of the plurality of retention arms engage the resilient seal when the MBS is fully engaged to female connector.

15. The sealed electrical connector assembly according to claim 13, wherein free ends of the plurality of retention arms contact the resilient seal when the MBS is fully engaged to female connector.

16. The sealed electrical connector assembly according to claim 11, wherein the female connector further comprises a plurality of female terminals configured to mate with the plurality of male terminals.

17. A sealed electrical connector assembly, comprising:

a female connector having a wall extending parallel to a mating axis and a resilient seal circumferentially extending from the wall; and a male connector having a shroud extending parallel to the mating axis and a moveable means for engaging and retaining the resilient seal as the shroud is inserted within the female connector between the inner and outer walls and a male blade stabilizer (MBS) defining flexible retraction locks, wherein the MBS is moveable from a pre-staged position to a fully staged position, wherein the female connector defines rigid retraction locks configured to engage the flexible retraction locks and pull the MBS from the fully staged position back to the pre-staged position as the male connector is withdrawn from the female connector.

18. The sealed electrical connector assembly according to claim 17, wherein the male connector further comprises a plurality of male terminals.

19. The sealed electrical connector assembly according to claim 17, wherein the MBS is integral with the moveable means for retaining the resilient seal.

* * * * *